US010215544B2

(12) United States Patent
Thomas

(10) Patent No.: US 10,215,544 B2
(45) Date of Patent: Feb. 26, 2019

(54) TIME-DELAYED MULTI-CHARGED DIVERSIONARY DEVICE

(71) Applicant: AMTEC Less Lethal Systems, Inc., Perry, FL (US)

(72) Inventor: Duncan Thomas, Birmingham (GB)

(73) Assignee: AMTEC Less Lethal Systems, Inc., Perry, FL (US)

( * ) Notice: Subject to any disclaimer, the term of this patent is extended or adjusted under 35 U.S.C. 154(b) by 0 days.

(21) Appl. No.: 15/498,830

(22) Filed: Apr. 27, 2017

(65) Prior Publication Data

US 2018/0313640 A1 Nov. 1, 2018

(51) Int. Cl.

| | |
|---|---|
| ***F42C 9/02*** | (2006.01) |
| ***F42C 9/14*** | (2006.01) |
| ***F42C 14/02*** | (2006.01) |
| ***F42B 27/00*** | (2006.01) |
| ***F42B 12/36*** | (2006.01) |
| ***F42B 12/42*** | (2006.01) |

(52) U.S. Cl.

CPC ..... *F42C 9/02* (2013.01); *F42B 12/36* (2013.01); *F42B 12/42* (2013.01); *F42B 27/00* (2013.01); *F42C 9/14* (2013.01); *F42C 14/02* (2013.01)

(58) Field of Classification Search

CPC .... F42B 8/18; F42B 8/26; F42B 12/36; F42B 12/42; F42B 12/46; F42B 27/00; F42B 27/08; F42C 9/02; F42C 9/14; F42C 14/02

USPC ..... 102/368, 482, 487, 498

See application file for complete search history.

(56) References Cited

U.S. PATENT DOCUMENTS

| | | | | |
|---|---|---|---|---|
| 7,963,227 | B1 * | 6/2011 | Brunn | F42B 8/26 102/360 |
| 9,103,638 | B2 * | 8/2015 | Thomas | F42B 12/36 |
| 9,261,339 | B2 * | 2/2016 | Mancini | F42B 12/42 |
| 9,989,341 | B2 * | 6/2018 | Robbins | F42B 12/46 |

FOREIGN PATENT DOCUMENTS

| | | | | |
|---|---|---|---|---|
| WO | WO-2016203200 | A1 * | 12/2016 | F42B 27/00 |
| WO | WO-2016203214 | A1 * | 12/2016 | F42B 8/26 |

* cited by examiner

*Primary Examiner* — James S Bergin
(74) *Attorney, Agent, or Firm* — Remenick PLLC

(57) ABSTRACT

A diversionary device capable of providing multiple discharges according to a prescribed time schedule. The device preferably assumes the same general form as a prior art stun grenade, including a safety pin that is pulled to arm the device and a spring-biased lever that is released when the device is deployed.

20 Claims, 9 Drawing Sheets

TIME-DELAYED MULTI-CHARGED DIVERSIONARY DEVICE

BACKGROUND OF THE INVENTION

Field of the Invention

The invention relates to the field of diversionary munitions. More specifically, the invention comprises a hand grenade having the ability to fire multiple separate charges in a desired time-delayed sequence.

Description of Related Art

In many law enforcement and tactical military situations it is desirable to provide a diversionary device. An example of such a device is a "flash/bang" grenade (sometimes also know as a "stun grenade"). A flash/bang grenade is typically armed and thrown in the same manner as a fragmentation grenade (a "frag"). However, unlike a frag grenade, a flash/bang device does not produce flying fragments. Instead, it produces a loud noise and typically a bright flash of light (though some produce comparatively little light).

The U.S. Army's M84 stun grenade produces a sound level sufficient to cause a temporary loss of hearing and impairment of balance. It produces a flash bright enough to impair vision for over 5 seconds, as well, as producing a persistent afterimage that may impair the aiming of a weapon for up to 30 seconds.

Stun grenades are often used when breaching a door and securing a room that is suspected to contain hostile occupants. The door is breached and a stun grenade is thrown into the room. Immediately after the detonation of the stun grenade an infiltration team storms into the room and engages the occupants. The idea is for the engagement to commence and be completed before the occupants have recovered from the effects of the flash/bang.

In other instances a flash/bang is used as a misdirection device. For example, a patrol trying to flank the right side of an enemy position might toss a flash/bang to the left. Upon the detonation of the diversionary device the patrol would then maneuver around the right. Unfortunately, however, traditional devices such as the M84 are only marginally effective as a diversionary device. They produce only a single report. In the diversionary role, the detonation may be too far from the enemy position to impair hearing or sight. Though it attracts attention, it only does so for a short while.

A better device would attract attention for a longer interval. It is also desirable for the device to create some doubt as to its nature. If, for example, the engaged adversary questions whether the flash/bang is a single explosion or may instead represent sustained fire from another weaponholder, a real tactical advantage is created. The present invention provides this functionality.

BRIEF SUMMARY OF THE INVENTION

The present invention comprises a diversionary device capable of providing multiple discharges according to a prescribed time schedule. The device preferably assumes the same general form as a prior art stun grenade, including a safety pin that is pulled to arm the device and a spring-biased lever that is released when the device is deployed.

Timing is provided by a timing drum moving at a controlled rate. The controlled rate may be provided by a piston moving through a metering fluid. The piston may include one or more metering orifices that control its rate of travel.

Multiple firing chambers are included in the device, each of which can receive a cartridge to be detonated. Each firing chamber is provided with a corresponding spring-loaded striker positioned to detonate a cartridge in the chamber. Each striker includes its own movable retainer. Each retainer holds its corresponding striker in a cocked position until the retainer is moved and the striker is released.

Slots are provided in the timing drum. These slots are positioned to cooperate with the movable retainers holding the strikers in the cocked position. As a particular slot in the timing drum is moved adjacent to a particular retainer, the retainer moves into the slot and thereby releases the corresponding striker. By varying the starting position of each slot on the drum, a delay between the firing of the individual strikers is obtained. In fact, within the constraints of the total movement of the timing drum, any desired sequence and timing of the multiple charges can be provided.

REFERENCE NUMERALS IN THE DRAWINGS

Figure 1:
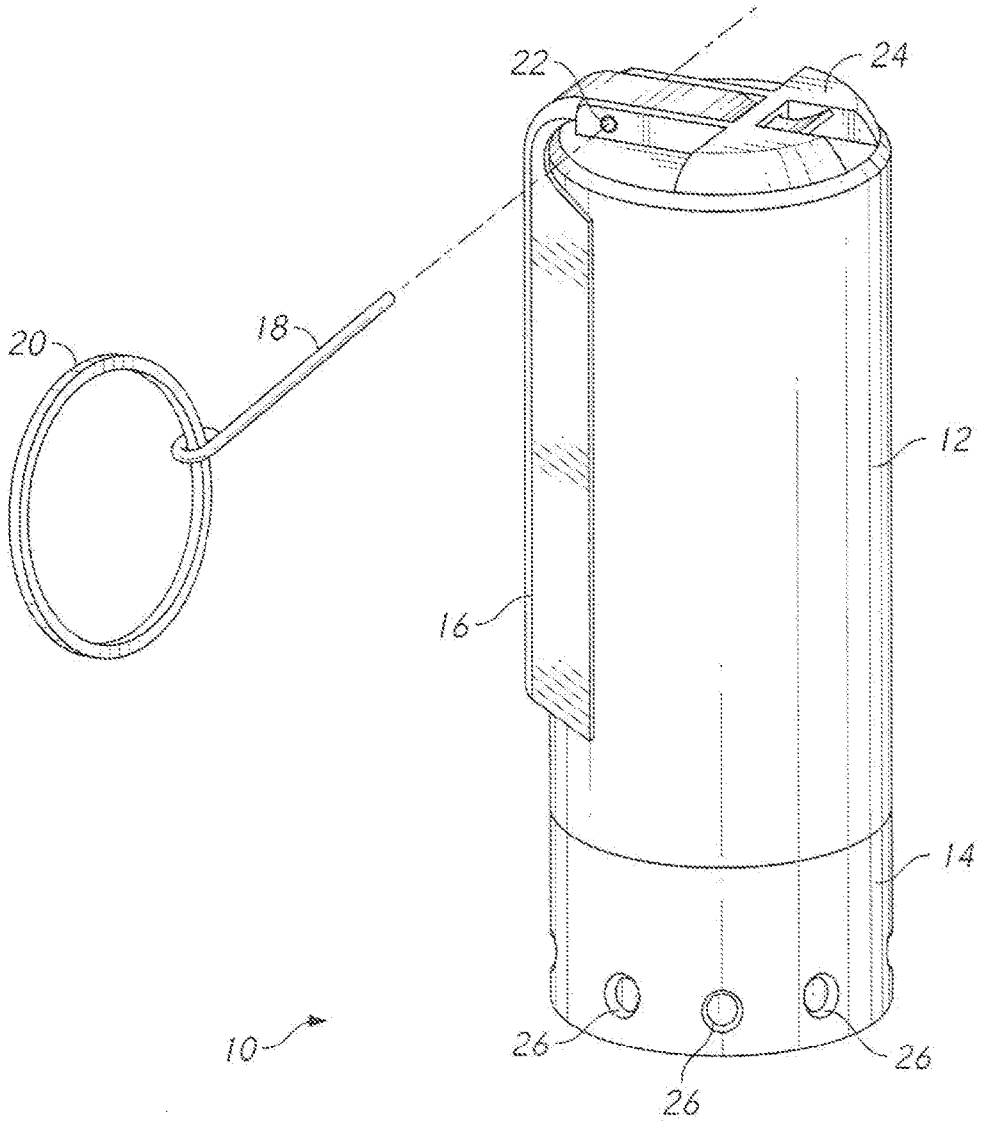
FIG. 1 is a perspective view, showing an embodiment of the present invention.

10 diversionary device
12 outer body
14 base
16 lever
18 safety pin
20 ring
22 pin receiver
24 lever retainer cap
26 blast port
28 firing chamber
30 spring well
32 core
33 timing spring
34 striker bore

36 tang
38 hook
40 through bore
42 paddle
44 slot
46 bridge
48 engagement feature
50 striker
52 striker spring
54 shoulder
56 nose
58 ball bearing retainer
60 transverse hole
62 transverse hole
64 cartridge
66 flange
68 engagement feature
72 timing drum
74 slot
76 rod
78 O-ring
80 piston
82 delay chamber
84 delay chamber cap
86 O-ring
88 receiver
90 leader slot
92 firing slot
94 tripping shoulder
96 metering orifice
98 bulkhead
100 timing drum chamber
102 adjustment rod
104 threaded bore
106 screwdriver slot
108 spring plate
110 delay rod top
112 rod top
114 delay rod top
116 bore
118 journal
120 delay rod top
122 slot
124 male interrupted thread
126 flat
128 rectangular slot
130 female interrupted thread
132 bore

DETAILED DESCRIPTION OF THE INVENTION

FIG. 1 shows a preferred embodiment of the present invention. Diversionary device 10 assumes the general form of a prior art stun grenade. Lever 16 is retained in the "safe" position via the insertion of a transverse safety pin 18 through pin receiver 22. The safety pin preferably includes an attached ring 20. The combination of the ring, pin, and lever preferably includes the functionality well known to those familiar with deploying grenades of various types.

As an example, the pin is preferably configured to remain in place until the user grasps the ring, twists the ring, and pulls the pin free. The device remains in a "safe" condition as long as lever 16 is pressed against the side of outer body 12. The lever is spring-biased away from the body. When the user throws the device, lever 16 pivots out and away from the body. This action initiates the firing sequence.

When the inventive grenade fires, a series of timed detonations blast sound out blast ports 26. Light flashes may also be produced. The device produces multiple reports—such as eight reports. The reports may be configured to occur in a defined time sequence, such as: blast-blast-pause-blast-blast-blast-pause-blast-blast-long pause-blast. The prolonged sequence enhances the confusion caused by the inventive diversionary device.

Figure 2:
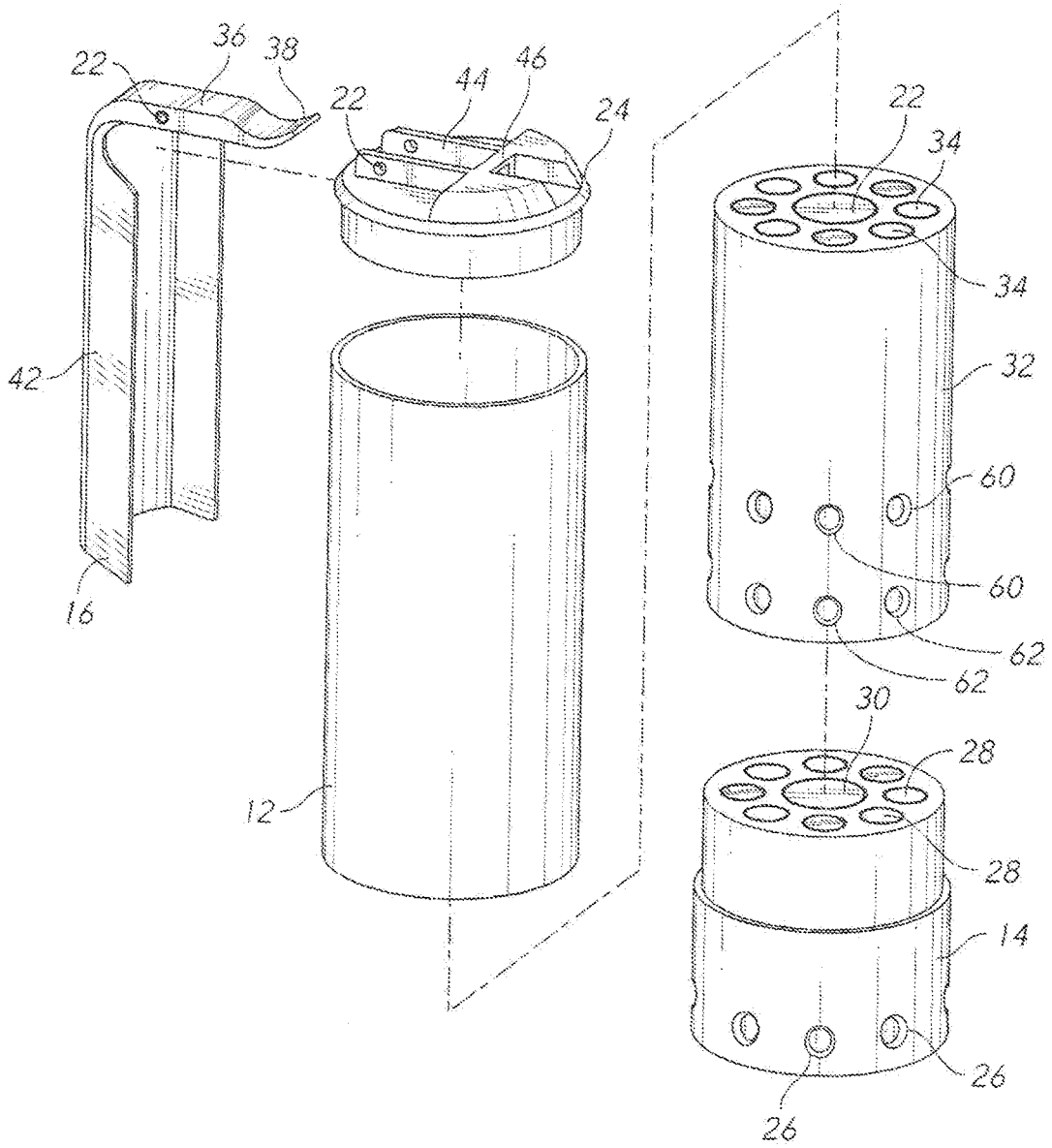
FIG. 2 is an exploded perspective view, showing the major components of a preferred embodiment.

The inventive mechanisms used to carry out the timed detonations may be realized in a wide variety of ways. FIGS. 2 through 7 illustrate one preferred embodiment. FIG. 2 is an exploded view showing the major components of the invention. The smaller internal components have been omitted for visual clarity. The major components are assembled into a "can" structure with outer body 12 linking them together. Core 32 is stacked on top of base 14 (Directional terms such as "on top" should be understood to refer to the orientation shown in the view and should not be viewed as limiting. The inventive device will function in any orientation. No directional term in this entire description should be viewed as limiting and should instead be assumed to apply only to the orientation shown in a particular view—unless stated otherwise). Outer body 12 slides over core 32 and the lower portion of outer body 12 links to base 14. Lever retainer cap 24 mounts over the top of core 32 and links to the top of outer body 12.

Lever 16 includes paddle 42 and tang 36 with hook 38 on its distal end. Tang 36 slides into slot 44 on lever retainer cap 24, with hook 38 hooking under bridge 46. Through-bore 40 in tang 36 aligns with pin receiver 22. The pin (not shown) is inserted through the aligned through-bore 40 and pin receiver 22.

Base 14 includes multiple firing chambers 28. In the example depicted, eight firing chambers are included in an equally-spaced radial array (centered on the central axis of the base). Spring well 32 is also included in base 14. Core 32 includes a corresponding radial array of striker bores 34. Each striker bore 34 contains a striker configured to detonate a cartridge placed in one of the firing chambers 28. Each striker bore is aligned with a firing chamber. Core 32 also contains delay chamber 82, which houses the timing mechanism for providing the timed detonation sequence. Transverse holes 60, 62 are provided through core 32 in a direction that is normal to its central axis.

Core 32 and base 14 may be made of aluminum. Those skilled in the art will quickly realize that the shapes shown for the base and the core in this particular example lend themselves to machining. The outside diameters can be turned on a lathe. Spring well 30 and delay chamber 82 can be bored or drilled. Firing chambers 28 and striker bores 34 can be drilled. Transverse holes 60, 62 and blast ports 26 can be drilled well. Other manufacturing techniques may be used as well, such as casting.

Figure 3:
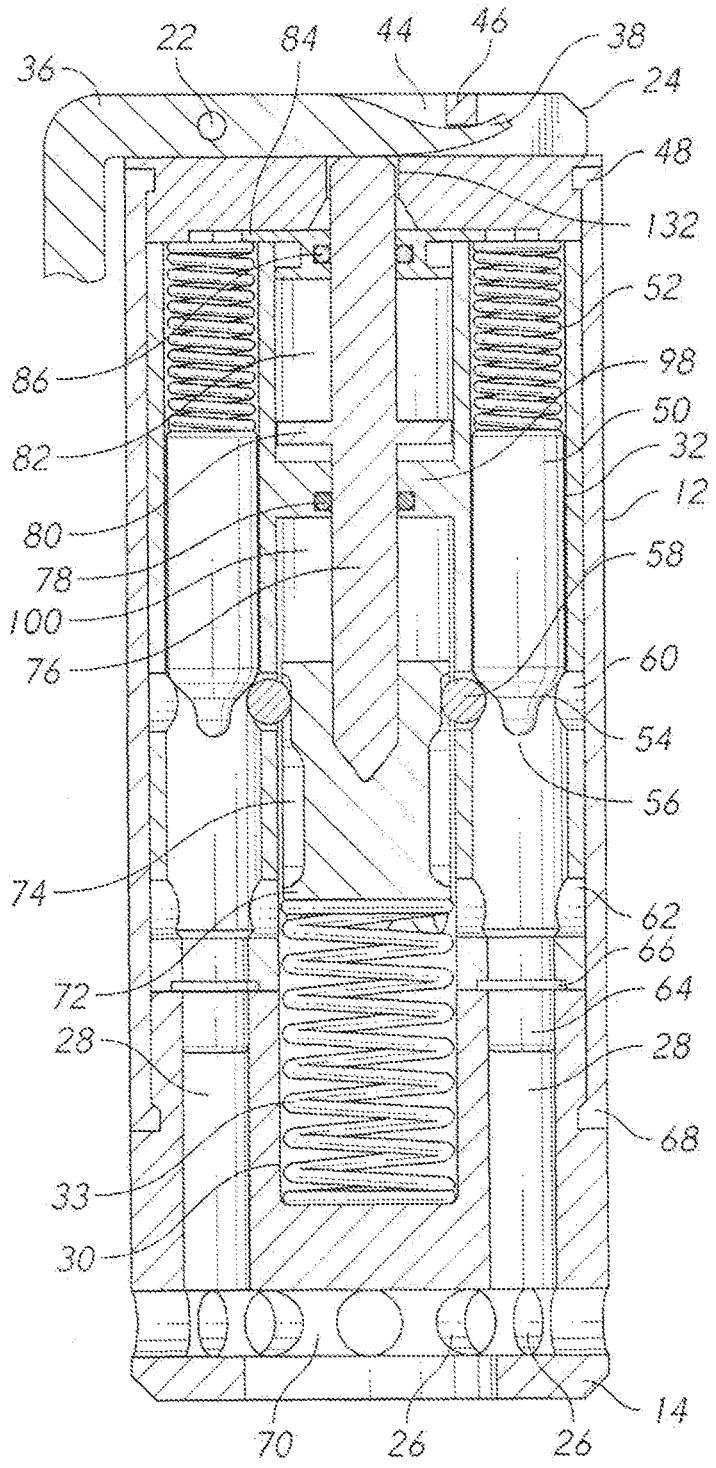
FIG. 3 is a sectional elevation view, showing a preferred embodiment in an assembled state.

FIG. 3 shows a sectional elevation view of the completed invention. The major components depicted in FIG. 2 are included, along with other internal components as well. Base 14 includes multiple firing chambers 28. In use, cartridges 64 are located in the firing chambers. Each cartridge 64 is any suitable device that can be detonated by s sharp blow on its base. The particular type of cartridge shown includes a flange 66 that seats into an annular flange recess in the top of the firing chamber. The lower portion of the base includes chamber 70. Multiple transverse blast ports 26 are provided that vent outward from chamber 70. The result is that a detonation of any particular cartridge 64 will cause a pressure wave to spread from all the blast ports and not just the particular blast port that is nearest the detonating cartridge.

Outer body 12 slides over the reduced-diameter portion of base 14 as shown. Engagement feature 68 is provided to connect the base and the outer body. The engagement feature could be a snap fit, a thread, or any other suitable connecting feature. It may provide a reversible or permanent connection.

Core 32 fits within outer body 12 and rests against base 14. The lower portion of the core actually captures the cartridges 64 in the firing chambers so that they are in position and ready to fire. The core captures other significant components as well. The lower portion of the core opens into timing drum chamber 100. Timing drum 72 slides into this chamber. In this embodiment, the timing drum is cylindrical. It slides within the cylindrical timing drum chamber. It is urged upward by timing spring 33, which rests within spring well 30 in the base.

The upper portion of the core opens into delay chamber 82. Delay chamber 82 is separated from timing drum chamber 100 by bulkhead 98. Rod 76 passes through the bulkhead and its lower portion connects to timing drum 72. The connection between the rod and the timing drum can be made by a thread, a press fit, an adhesive joint, or other type of connection. The result is that rod 76 moves in unison with the timing drum.

Piston 80 is connected to rod 76 and may in fact be made as in integral part of the rod. The piston moves within delay chamber 82. The delay chamber is filled with a fluid of suitable viscosity (a "delay fluid"). The fluid may be a gas or it may be a liquid. Piston 80 may also contain one or more metering orifices allowing the delay fluid to pass through the piston. Alternatively, a small clearance may be provided between the piston's outer perimeter and the wall of the delay chamber.

The upper portion of the delay chamber is sealed by delay chamber cap 84. The delay chamber cap also mounts an O-ring 86 to prevent leakage around the upper portion of rod 76. Likewise, bulkhead 98 mounts an O-ring 78 to prevent leakage around the rod's lower portion. The O-rings assure that delay fluid does not escape the delay chamber and that the piston must therefore move through the delay fluid without forcing the fluid out of the delay chamber.

As shown in FIG. 3, the upper portion of rod 76 protrudes through bore 132 in lever retention cap 24 and bears against the underside of tang 36. This interface retains the components in the position shown. Piston 80 is resting within the lower portion of the delay chamber. However, once the pin is pulled and the lever is released, the top of rod 76 will force tang 36 upward. Hook 38 will pivot under bridge 46 and the lever will fly away (The upward force of timing spring 33 causes the top of rod 76 to flip tang 36 up and away). The rod and timing drum do not pop up instantaneously, however. The rate of movement of piston 80 through delay chamber 86 is regulated by the presence of the delay fluid. A relatively high viscosity delay fluid will cause the piston to move upward quite slowly whereas a relatively low viscosity delay fluid (such as a gas) will cause it to move upward relatively rapidly.

Lever retainer cap 24 rests over the top of delay chamber cap 84 and core 32. The lever retainer cap is connected to the upper portion of outer body 12 via engagement feature 48. As for the connection between the outer body and the base, the connection at 48 may be a snap, a thread, or any other suitable connection. Whatever form it takes, this connection affixes lever retainer cap 24 to the top of the device.

The reader should recall that timing drum 72 moves in unison with the rod and piston. Thus, when the pin is pulled and the lever is released, the timing drum moves up with the rod. The timing drum is central to the firing mechanism for the inventive device, which will now be described.

Directly above each firing chamber 28 lies a striker 50 (sliding within a striker bore 34 in core 32). A striker spring 52 urges each striker downward toward its corresponding firing chamber. Each striker 50 includes a nose 56, which is shaped to detonate a cartridge. Proximate the nose is shoulder 54. In this version each striker is a radially symmetric shape such as might be turned on a lathe.

FIG. 3 shows each striker 50 in a cocked position—ready to fire. A ball bearing retainer 58 retains each striker in the cocked position until the timing mechanism releases it. Looking at the striker 50 in the right side of FIG. 3, the reader will note that bearing retainer 58 rests within transverse hole 60 through core 32. The reader will note how the concave shape of shoulder 54 engages ball bearing retainer 58 and tends to urge it inward toward timing drum 72. The timing drum, however, limits the inward travel of the ball bearing retainer. Thus, the ball bearing retainer is held in position within transverse hole 60. Its presence holds striker 50 in the cocked position.

But, as timing drum 72 moves upward (once the pin and lever are released), ball hearing retainer 58 will drop into an aligned slot 74 in the timing drum. The presence of the slot in the timing drum allows the shoulder 54 on the striker to push ball bearing retainer 58 inward toward the central axis of the inventive device until the striker clears the ball bearing retainer and fires downward. Once ball bearing retainer 58 drops into slot 74, striker spring 52 propels striker 50 into cartridge 64. Nose 56 on the striker then detonates the cartridge.

Figure 7:
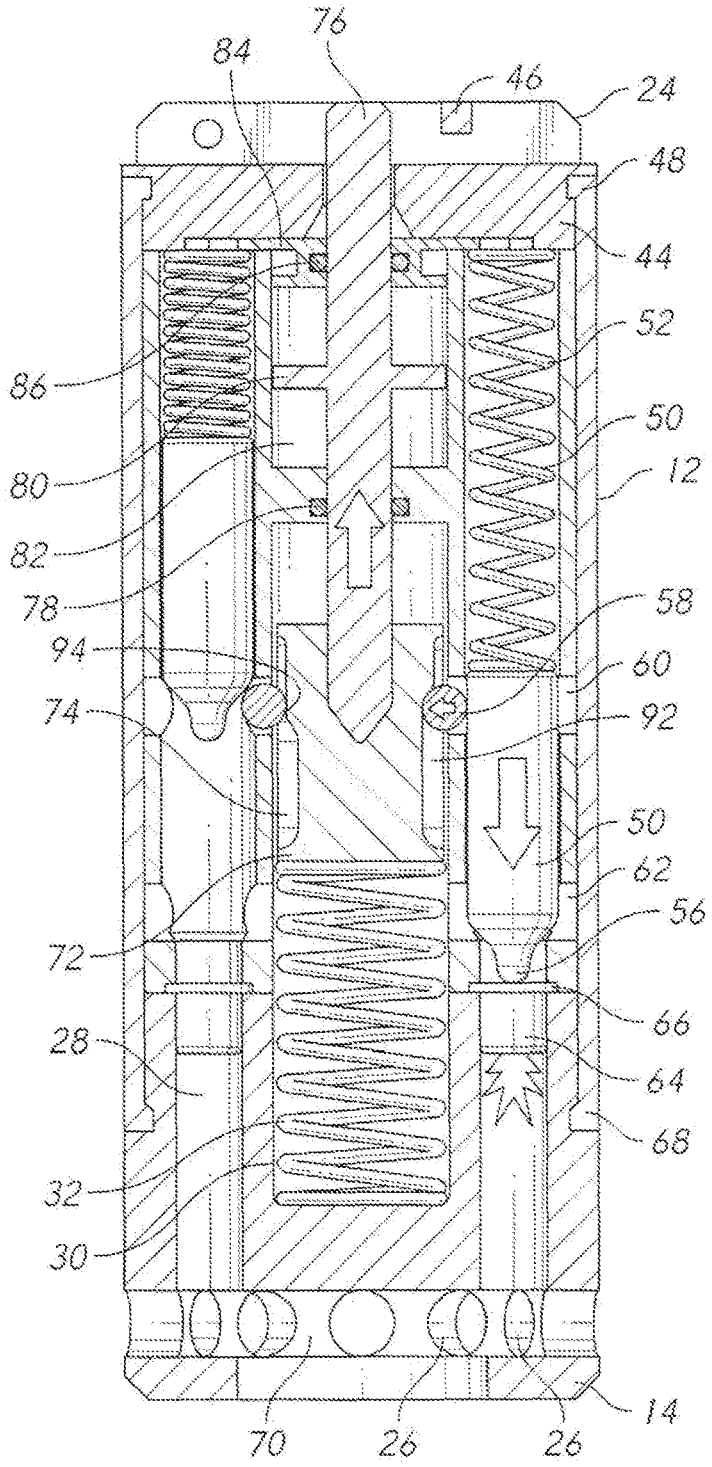
FIG. 7 is a sectional elevation view, showing the firing of one striker.

FIG. 7 shows this progression for the striker shown on the right in FIG. 3. Timing drum 72 is moving upward as indicated by the arrow in FIG. 7. When it has moved far enough, ball bearing retainer 58 drops into firing slot 92 in the timing drum. The lateral movement of the ball bearing retainer is indicated by the arrow. The lateral movement of the ball bearing retainer allows it to clear the striker. Striker spring 52 then propels the striker downward and nose 56 contacts and detonates cartridge 64.

The reader will note that transverse hole 62 exists near the bottom of the striker's travel. This transverse hole acts as a vent. It allows the air resting in front of the striker to exit the striker bore as the striker moves toward the cartridge. In the absence of the vent, the velocity of the striker would be reduced.

Figure 4:
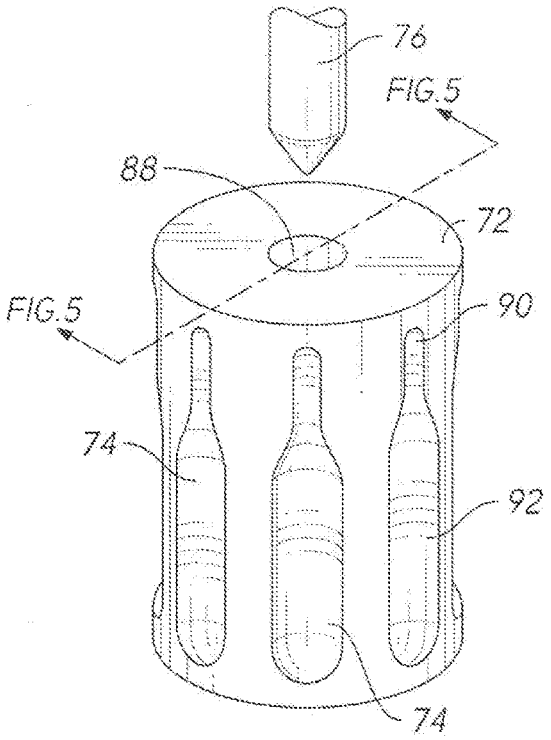
FIG. 4 is a perspective view, showing some details of the timing drum.

In order to understand how this firing mechanism produces a desired and predetermined time delay, some additional details of the timing drum must be explained. FIG. 4 shows a perspective view of timing drum 72. Receiver 88 is provided in its upper end (Again—directional terms refer only to the orientation shown in the view as the inventive device will function in any orientation). The lower end of rod 76 fits into receiver 88 and attaches the rod to the timing drum.

In this embodiment the inventive device has eight firing chambers and eight strikers. Accordingly, the timing drum has eight slots 74 cut into its outward-facing cylindrical surface. Each slot includes two aligned portions—a leader slot 90 and a firing slot 92. The slots may assume many different forms. In the version shown, the slots may be made by using a ball end-mill cutting to a variable depth. For the leader slot, the ball end-mill is run at a shallow depth. For the firing slot, the ball end-mill is run at a deeper depth.

In the starting position shown in FIG. 3, each ball bearing retainer 58 is resting within a leader slot 90 in the timing drum. The leader slot is deep enough to engage the ball bearing retainer, but not deep enough to allow the ball bearing retainer to disengage its corresponding striker and allow it to fire.

Figure 5:
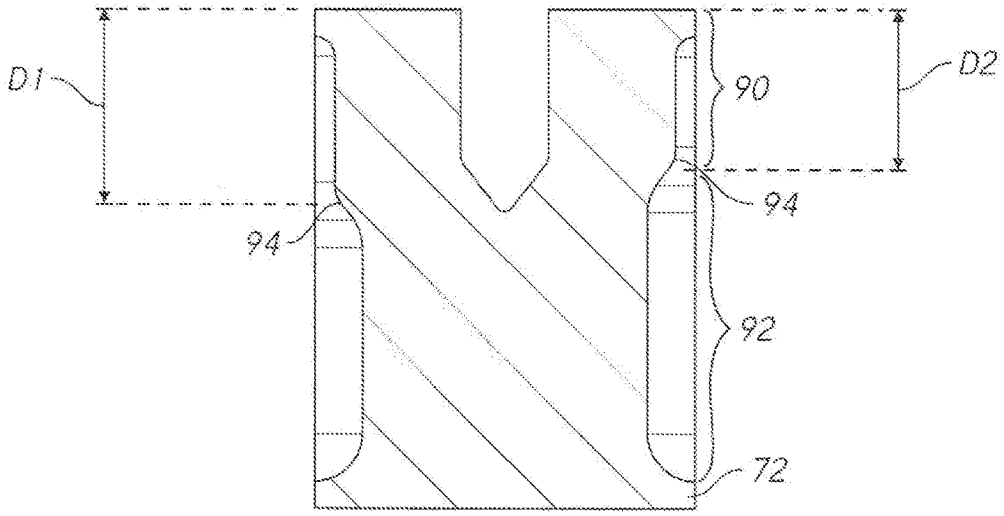
FIG. 5 is a sectional elevation view, showing some details of the timing drum.

Returning to FIG. 4, the reader will notice a "callout" for the sectional view of FIG. 5. FIG. 5 provided a sectional view of the timing drum, taken through two slots on opposite sides of the timing drum. The portion of each slot where the leader slot deepens to form the firing slot is called a "tripping shoulder." Each slot contains a tripping shoulder 94 as shown. When the respective ball bearing retainer 58 rolls over this tripping shoulder the respective striker fires.

In looking at FIG. 5, the reader will perceive that the tripping shoulder 94 shown on the right slot is higher than the one shown on the left slot. The distance from the top of the timing cylinder to the tripping shoulder on the right ("D2") is smaller than the distance to the tripping shoulder on the left ("D1"). Recall that once the pin and lever are released, the timing drum moves upward at a controlled rate. This fact means that the ball bearing retainer riding in the slot on the right in the view will ride over the tripping shoulder at D2 (and release its corresponding striker) before the ball bearing retainer on the left in the view will ride over the tripping shoulder at D1. Thus, a delay will occur between the releasing of the two respective strikers.

Returning now to FIG. 4, the reader will note that the various slots 74 can be provided with any desired length and position. Further, the timing drum can be given a wide variety of travel speeds. For example, the delay from the firing of the first charge to the last charge could be 1 full second. It could be as little as 300 milliseconds. It could be as long as 5 seconds or even more. Swapping out the timing cylinder allows the user to vary the timing and sequence of detonation.

Figure 6:
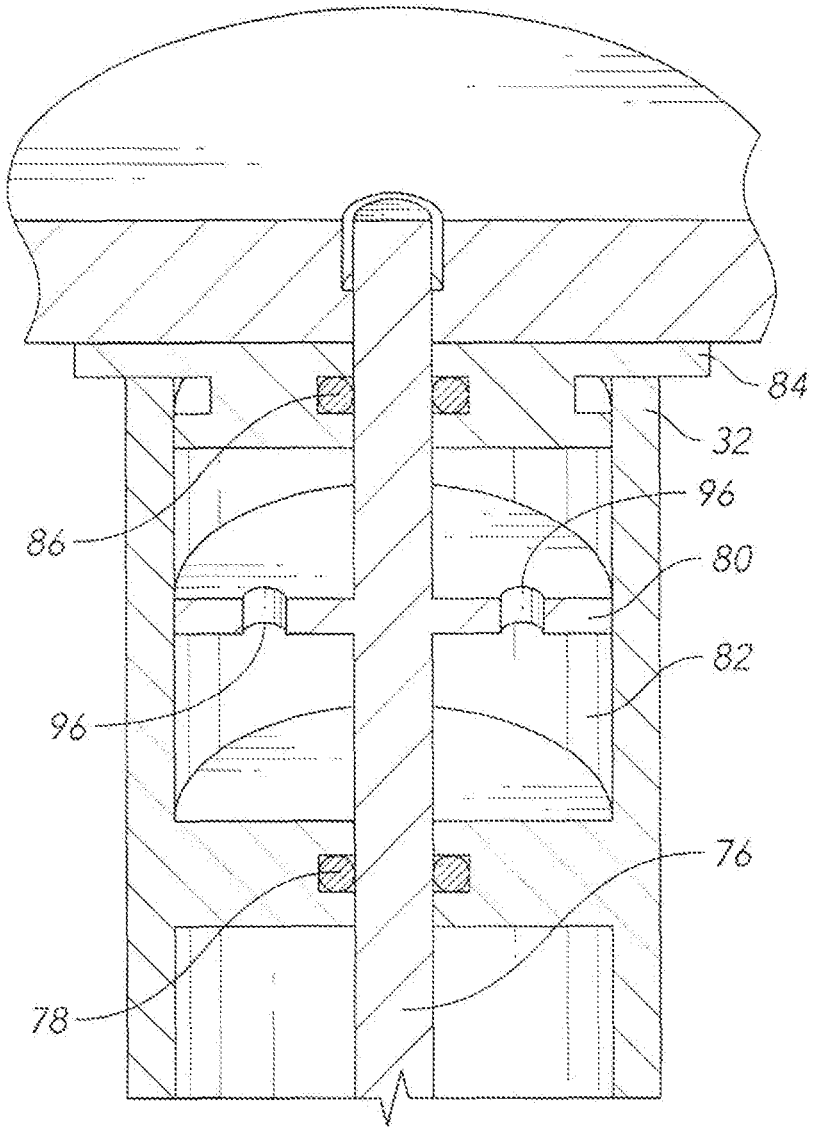
FIG. 6 is a sectional perspective view, showing some features of the delay chamber.

FIG. 6 shows some additional details regarding delay chamber 82. In this version two metering orifices 96 pass though piston 80. These allow delay fluid to pass from in front of the traveling piston to behind it as the piston progresses through the chamber. The reader will also observe how O-rings 78 and 86 seal the interface between rod 76 and the ends of the delay chamber. The motion of the piston is primarily governed by (1) the spring coefficient of timing spring 33; (2) the pre-load applied to the timing spring when the piston is in its starting position; (3) the size of the metering orifices; and (4) the viscosity of the delay fluid in the chamber.

Returning now to FIG. 3, another selectable timing feature will be described. FIG. 3 shows how a portion of tang 36 rests over the upper extreme of rod 76. The presence of tang 36 prevents any motion by the rod and thereby prevents the start of the timed ignition sequence. In some instances it is desirable to provide an extended delay before the first cartridge is detonated. For example, when the inventive device is thrown it may travel through the air for 1 to 2 seconds. In many cases it is preferable for the device to be silent during this trajectory.

However, in other cases, it is desirable for the first cartridge to be detonated in a much shorter interval. In a door-breaching scenario, for example, the inventive diversionary device should start detonating as soon as it is thrown through a gap between a door and its frame. Since it is difficult to know the scenario that will be encountered beforehand, it is preferable to provide the inventive device with a switchable delay mechanism. Such a mechanism can be provided in tang 36.

A movable block can be provided in the portion of tang 36 overlying the end of rod 76. if a short delay before the first detonation is desired, this movable block can be switched so that the end of rod 76 travels upward and stops at a point just before the first ball bearing retainer reaches its corresponding tripping shoulder. If, on the other hand, a long delay is desired, the movable block can be moved to push the rod end fully inward as shown in FIG. 3. The moving block could even be provided with a camming surface so that switching between the two modes could be done several times before the inventive grenade is actually deployed.

Figure 8:
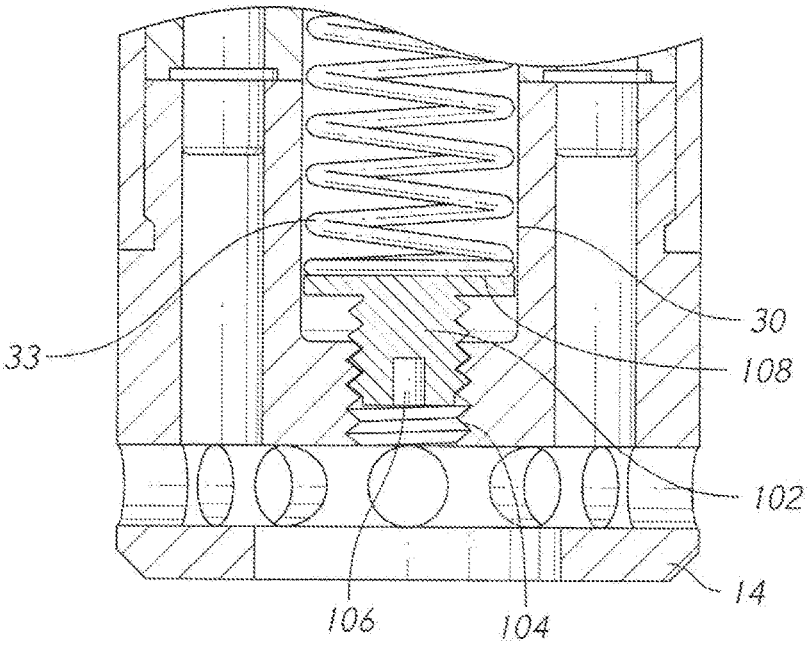
FIG. 8 is a sectional elevation view, showing an additional timing adjustment device.

Many other features may optionally be included to allow the user to alter the timing of the mechanism. FIG. 8 shows one such device. In this version the bottom of spring well 30 opens into threaded bore 104. Adjustment rod 102 threads into this hole. Screwdriver slot 106 is provided on the outward-facing portion of adjustment rod 102. Spring plate 108 is positioned to bear against the end of timing spring 103. A user can alter the spring bias by inserting a screwdriver into screwdriver slot 106 and increasing or decreasing the load on the spring. An increased spring load causes the timing mechanism to progress more rapidly and a decreased spring load causes it to progress less rapidly.

A female hexagonal socket suitable for an Allen key could be substituted for the screwdriver slot. Other embodiments might also include a locking plug that threads into the same hole and secures the adjustment rod in place so that it cannot turn.

Figure 9:
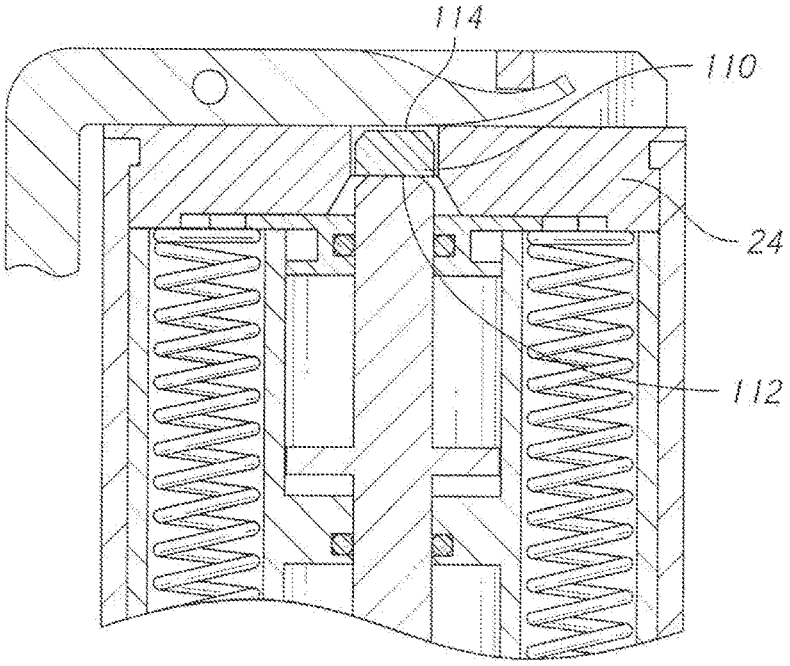
FIG. 9 is a sectional elevation view, showing one embodiment of a timing adjustment component added to the rod top.

FIG. 9 shows another variable-delay embodiment. In this version a short delay rod 110 is placed over rod top 112. Delay rod top 114 actually bears against the bottom of tang 36. The delay rod can be placed in some assemblies to increase the time before the first cartridge is detonated. It may also be omitted from other assemblies to decrease the delay before the first detonation. The presence or absence of the delay rod sets the initial position of the timing drum. When the delay rod is absent, the timing drum starts in a higher initial position (with the directional term "higher" being understood only to refer to the orientation shown in FIG. 9). An experienced user could also remove delay rod 110 in order to convert a "long delay" version of the inventive device to a "short delay." In order to do this the operator would pull the pin and carefully remove the lever. The timing mechanism would actuate and the delay rod could be grasped and removed. The lever and pin would then be replaced.

Figure 10:
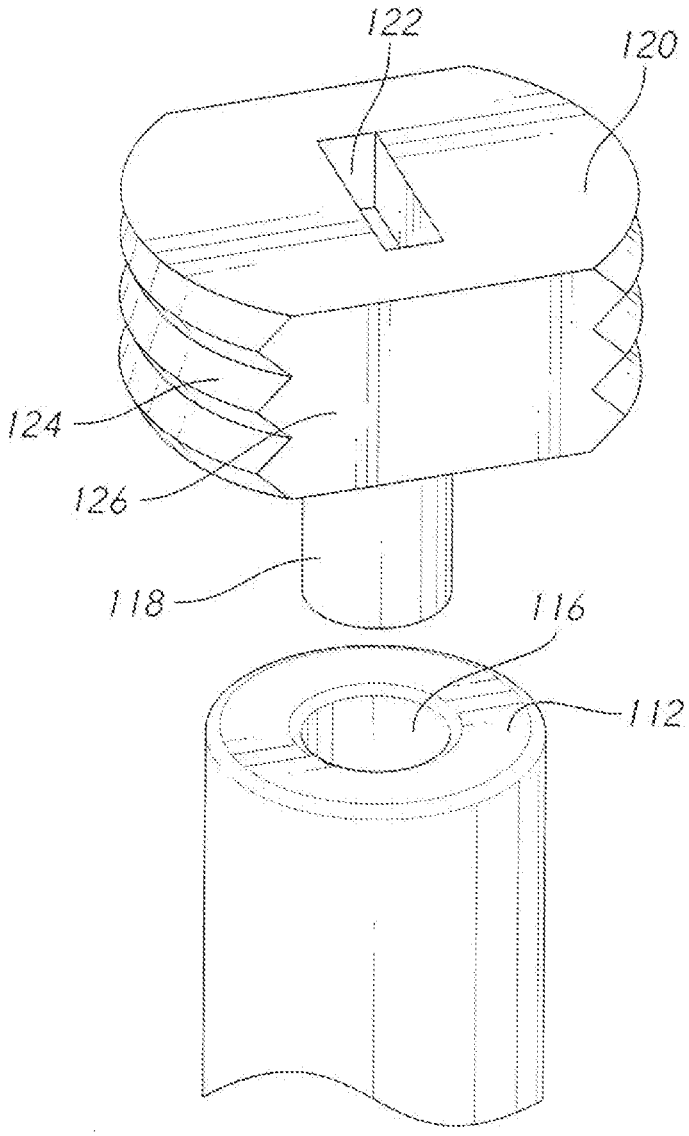
FIG. 10 is a perspective view, showing another embodiment of a timing adjustment component added to the rod top.

A more-sophisticated variable timing embodiment is depicted in FIGS. 10-13. FIG. 10 shows rod top 112 (the uppermost portion of rod 76). Bore 116 is provided in the rod top. This bore receives journal 118 protruding from the bottom, of delay rod top 120. Delay rod top 120 is thereby able to freely pivot on rod top 112.

Delay rod top 120 is provided with male interrupted thread 124. The male thread is interrupted by a pair of parallel flats 126 (one on either side of the delay rod top). One way to make the delay rod top is to provide a normal male thread on a cylindrical exterior—then grind or cut the two parallel flats 126. This is by no means the only way to make the part, but it serves to explain the desired geometry.

Slot 122 is provided in the outward-facing surface of delay rod top 120. This allows an external tool to adjust the rotational position of delay rod top 120. A hexagonal recess or other similar recess could alternatively be provided.

Figure 11:
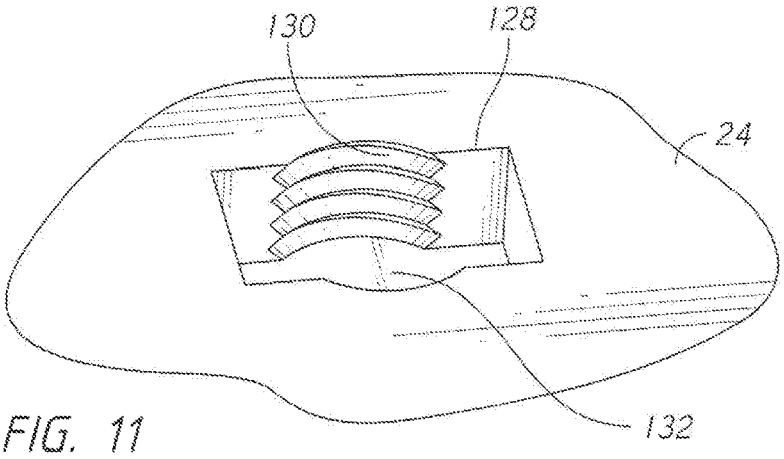
FIG. 11 is a detailed perspective view, showing a slot in the lever retainer cap configured to include an additional timing delay mechanism.

FIG. 11 shows a modified version of lever retainer cap 24 that is configured for use with the delay rod top shown in FIG. 10. Bore 132 through the lever retainer cap is provided with female interrupted thread 130 and rectangular slot 128. Female interrupted thread 330 is configured to engage male interrupted thread 124 on delay rod top 120.

Figure 12:
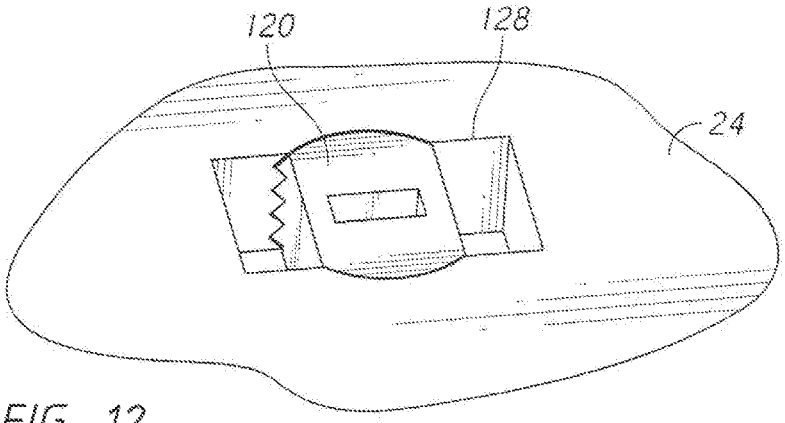
FIG. 12 is a detailed perspective view, showing a slot in the lever retainer cap configured to include an additional timing delay mechanism.
Figure 13:
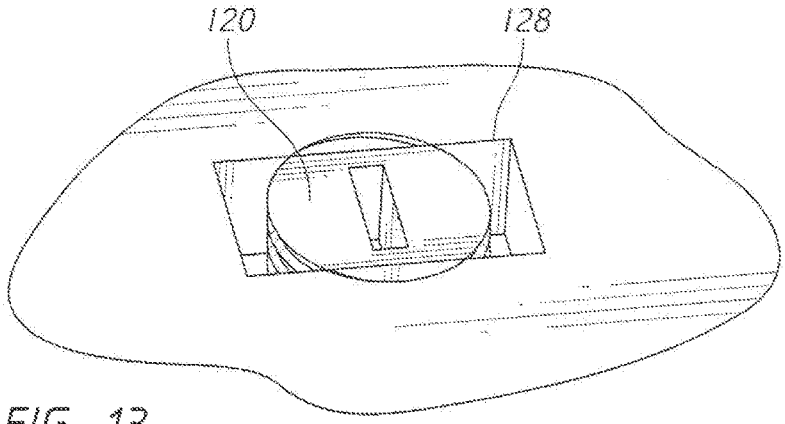
FIG. 13 is a detailed perspective view, showing a slot in the lever retainer cap configured to include an additional timing delay mechanism.

FIGS. 12 and 13 show ways in which this embodiment may be set to vary the delay provided. In FIG. 12, delay rod top 120 has been rotated so that the male interrupted thread on the delay rod top is engaged with the female interrupted thread in the bore. When the pin is pulled and the lever is released, the rod will rise. However, its rate of rise will be limited by the fact that delay rod top 120 must rotate through 90 degrees until the two flats 126 on delay rod top 120 are aligned with rectangular slot 128 (and the threads are then disengaged). The frictional engagement of the threads will slow the rise rate for the delay rod top and the rod to which it is attached. Once the threads are disengaged delay rod top 120 will rise without any further rotation.

If the user wants a shorter delay, he or she rotates delay rod top 120 to the position shown in FIG. 13. In this position the flats 126 on the delay rod top are aligned with the sides of rectangular slot 128. If the pin is pulled and the lever is removed at this point, the delay rod top 120 will rise without rotation. Thus, rotating the delay rod top to the position shown in FIG. 13 produces a relatively short delay whereas rotating it to the position shown in FIG. 12 produces a relatively long delay.

The user-selectable positions ultimately control an initial rate of motion of the timing drum. If the interrupted threads are engaged, then the initial motion of the timing drum will be slow until the threads are disengaged and the rate of motion then increases. If the interrupted threads are not engaged, then the initial rate of motion will just be the normal rate for the embodiments in which no additional user-selectable delay device (such as the interrupted thread) is provided.

The same type of interrupted thread arrangement could be used at any convenient location along the length of the rod or the other components attached to the rod. For example, an interrupted thread could be provided in the timing cylinder itself. Numerous other features and combinations could be provided. These include:

(1) Shapes other than a radially-symmetric configuration. The inventive device is not limited to the cylindrical configuration illustrated. Further, the illustrated embodiments use an equal radial spacing for all the firing chambers and this need not be the case;

(2) The retainers used to hold the strikers in the "cocked" position need not be spherical. Spherical "ball bearing" retainers are illustrated. However, many other shapes could be used as well;

(3) The device may be made reloadable and reusable. For example, a cocking lever could be provided to return all the strikers to the cocked position. The base may be made removable so that the spent cartridges can be removed and replaced with fresh ones;

(4) The delayed motion of the timing drum may be produced using a mechanism other than a piston. For example, the rate of motion of the rod might be limited by driving a gear motor that accelerates a flywheel;

(5) The bias provided by the timing spring might be replaced by gas pressure acting on a piston;

(6) The use of the term "drum" for the timing drum should not be construed as limiting this component to cylindrical shapes. As one example, the timing drum could have a rectangular cross-section riding in a broached slot; and (7) The slots shown in the timing drum are circular in cross section (such as made by a ball cutter). However, they could be vee-grooves or any other suitable shape.

The preceding description contains significant detail regarding the novel aspects of the present invention. It should not be construed, however, as limiting the scope of the invention but rather as providing illustrations of the preferred embodiments of the invention. Accordingly, the scope of the invention should be determined by reference to the claims ultimately presented rather than the examples given.

Having described my invention, I claim:

1. A diversionary device for setting off multiple cartridges housed within a common container in a timed sequence, comprising:

(a) a plurality of firing chambers, with each firing chamber being configured to receive one of said cartridges;

(b) a plurality of strikers, with each striker being configured to detonate one of said cartridges when said striker is released from a cocked position;

(c) a plurality of retainers, with each retainer being configured to retain one of said strikers in said cocked position;

(d) a timing drum, movable between a first position and a second position, said timing drum being urged toward said second position by a timing spring;

(e) a piston connected to said timing drum, said piston moving within a delay chamber filled with a delay fluid;

(f) said timing drum including a firing slot for each of said retainers; and (g) said firing slots being configured such that said retainers are held against said strikers and thereby retain said strikers in said cocked position when said drum is in said first position, but said firing slots sequentially receive said retainers as said timing drum moves toward said second position thereby sequentially releasing said strikers and creating a desired firing sequence.

2. The diversionary device as recited in claim 1, wherein:

(a) said firing chambers and strikers are arranged in a radial array; and (b) said timing drum is in a center of said radial array.

3. The diversionary device as recited in claim 1, wherein:

(a) said piston is connected to said timing drum by a rod; and (b) said firing slots run parallel to said rod.

4. The diversionary device as recited in claim 3, wherein said retainers are ball bearings.

5. The diversionary device as recited in claim 4, wherein:

(a) each said firing slots is connected to a parallel leader slot; and (b) when said timing drum is in said first position, each of said retainers rests in a leader slot.

6. The diversionary device as recited in claim 4, wherein:

(a) each striker rests within a striker bore; and (b) each retainer rests within a hole running transverse to said striker bore.

7. The diversionary device as recited in claim 6, wherein each striker contains a nose and a surrounding shoulder configured to engage one of said ball bearing retainers.

8. The diversionary device as recited in claim 1, wherein said piston includes at least one metering orifice.

9. The diversionary device as recited in claim 1, wherein said first position of said timing drum is selectable by said user, with said selection producing a different delay.

10. The diversionary device as recited in claim 1, further comprising a user-selectable delay device configured to control an initial rate of motion of said drum.

11. A diversionary device for setting off multiple cartridges housed within a common container in a timed sequence, comprising:

(a) a plurality of firing chambers, with each firing chamber being configured to receive one of said cartridges:

(b) a plurality of strikers, with each striker being configured to detonate one of said cartridges when said striker is released from a cocked position:

(c) a plurality of retainers, with each retainer being configured to retain one of said strikers in said cocked position:

(d) a timing drum, movable between a first position and a second position, with said motion of said timing drum being controlled to proceed at a desired rate of speed;

(e) said timing drum including a firing slot for each of said retainers; and (f) said firing slots being configured such that said retainers are held against said strikers and thereby retain said strikers in said cocked position when said drum is in said first position, but said firing slots sequentially receive said retainers as said timing drum moves toward said second position thereby sequentially releasing said strikers and creating a desired firing sequence.

12. The diversionary device as recited in claim 11, wherein:

(a) said firing chambers and strikers are arranged in a radial array; and (b) said timing drum is in a center of said radial array.

13. The diversionary device as recited in claim 11, further comprising:

(a) a piston moving through a delay fluid, said piston being connected to said timing drum by a rod; and (b) wherein said firing slots run parallel to said rod.

14. The diversionary device as recited in claim 13, wherein said retainers are ball bearings.

15. The diversionary device as recited in claim 14, wherein:

(a) each of said firing slots is connected to a parallel leader slot; and (b) when said timing drum is in said first position, each of said retainers rests in a leader slot.

16. The diversionary device as recited in claim 14, wherein:

(a) each striker rests within a striker bore; and (b) each retainer rests within a hole running transverse to said striker bore.

17. The diversionary device as recited in claim 16, wherein each striker contains a nose and a surrounding shoulder configured to engage one of said ball bearing retainers.

18. The diversionary device as recited in claim 13, wherein said piston includes at least one metering orifice.

19. The diversionary device as recited in claim 11, wherein said first position of said timing drum is selectable by said user, with said selection producing a different delay.

20. The diversionary device as recited in claim 11, further comprising a user-selectable delay device configured to control an initial rate of motion of said drum.

* * * * *